United States Patent [19]

Seeger et al.

[11] 4,366,800

[45] Jan. 4, 1983

[54] DWELL ANGLE CONTROL FOR INTERNAL COMBUSTION ENGINE IGNITION SYSTEM

[75] Inventors: Karl Seeger, Markgröningen; Werner Jundt, Ludwigsburg; Manfred Mezger, Markgröningen; Uwe Kiencke, Ludwigsburg, all of Fed. Rep. of Germany

[73] Assignee: Robert Bosch GmbH, Stuttgart, Fed. Rep. of Germany

[21] Appl. No.: 213,590

[22] Filed: Dec. 5, 1980

[30] Foreign Application Priority Data

Mar. 14, 1980 [DE] Fed. Rep. of Germany ..... 3009821

[51] Int. Cl.[3] ..... F02P 5/04

[52] U.S. Cl. ..... 123/609; 123/416; 123/650; 123/644

[58] Field of Search ..... 123/609, 612, 613, 644, 123/656, 652, 414, 416

[56] References Cited

U.S. PATENT DOCUMENTS

| | | | |
|---|---|---|---|
| 4,018,202 | 4/1977 | Gartner | 123/609 |
| 4,253,443 | 3/1981 | Seeger et al. | 123/609 |
| 4,276,860 | 7/1981 | Capurka | 123/609 |

FOREIGN PATENT DOCUMENTS

| | | | |
|---|---|---|---|
| 2655948 | 6/1978 | Fed. Rep. of Germany | 123/416 |

*Primary Examiner*—P. S. Lall

*Attorney, Agent, or Firm*—Frishauf, Holtz, Goodman & Woodward

[57] ABSTRACT

A dwell angle control has three counting devices for detecting acceleration. In a first UP/DOWN counter (17), the count in one direction takes place throughout the time the current in the primary circuit of an ignition coil (25) exceeds a current threshold value (I1). The count in the other direction is constant with respect to time. The counts on the first counter are taken over into a second UP/DOWN counter (11) in response to the input signal, the counting direction also being determined by the input signals. When the count in the second counter (11) reaches an adjustable trigger threshold value, the closure time is initiated, the actual ignition time being fixed by an edge of a sensed signal, or the edge of the signal from an ignition computer. The adjustable trigger threshold value is advantageously determined by a third UP/DOWN counter (12) which is set to a fixed value (X) by an edge of the sensed signal and whose counting direction is also determined by the sensed signals. A very good dynamic response is achieved by the detection of acceleration by three counters during different time periods. It is advantageous to switch from a decrease in closure angle to an increase in closure angle at an adjustable speed by switching the adjustable trigger threshold value to a very small value and switching the counter (11) to a continuous DOWN count. This allows a matching to variable ON/OFF ratios of the sensed signal.

6 Claims, 3 Drawing Figures

DWELL ANGLE CONTROL FOR INTERNAL COMBUSTION ENGINE IGNITION SYSTEM

The present invention relates to an ignition system for internal combustion engines having a dwell angle control system.

BACKGROUND

Ignition systems to which this invention relates are known, see U.S. Pat. Nos. 4,174,696; 4,063,539; and U.S. Ser. No. 06/221,788, SEEGER, filed Dec. 31, 1980, now U.S. Pat. No. 4,337,744 to which German Disclosure Documents DE-OS No. 2 746 885, DE-OS No. 2 850 113 and DE-OS No. 2 850 115 correspond.

Some of these known ignition systems operate according to the principle of dwell angle decrease and some according to the principle of dwell angle increase. This means that a prescribed basic dwell angle set by a rotating signal generator or an ignition computer is either decreased as a function of speed (a large basic dwell angle is required) or increased (a small basic dwell angle is required). The principle underlying both operations is to determine the count on the counter in dependence on the flow of current on the primary side of the ignition coil, this count in turn influencing the counting process for determining the start of the dwell time. The known closure angle regulators have the common disadvantage that they require a sensed signal, or the output signal of a ignition computer, whose ON/-OFF ratio is within a predetermined narrow range. It is therefore necessary to construct different sensor types or computer types depending upon the speed of the particular internal combustion engine.

THE INVENTION

It is an object to provide a control circuit which is versatile and permits operation with signals having widely varying ON/OFF ratios, and which has good dynamic response, as well as permitting efficient use of current flow to an ignition coil.

Briefly, a group of three UP/DOWN counters is provided, in which one counter has its counting process in one direction controlled by the interval of current flow in the primary circuit of the ignition coil, and its other counting direction at a constant rate; a second UP/DOWN counter receives the counting values of the first counter under control of a sensed signal, the counting direction being determined by the sensed signal. When the second counter reaches a triggering threshold value, a controlled switch closes an electrical circuit through a primary of the ignition coil, the switch being opened in response to an edge of the sensed signal, to cause an ignition event or a spark at a spark plug.

In accordance with the invention, a third UP/-DOWN counter is provided to control the adjustable triggering value. The third UP/DOWN counter is set to a fixed value, which may be hard wired, by one edge of the sensed signal; the counting direction of the third UP/DOWN counter is determined by the sensed signals.

In accordance with a preferred feature, the final count of the third counter is stored in a buffer storage after each UP/DOWN count, the value stored in the buffer store as well as the value of the second counter being applied to a comparator whose output, in turn, controls the electronic switch which connects, or disconnects, respectively, current flow through the ignition coil. In accordance with a feature of the invention, the triggering threshold value of the second counter can be changed between two values which, in turn, are selected with reference to a predetermined engine speed.

ADVANTAGES OF THE INVENTION

The ignition system according to the present invention has the advantage, that because of the speed-dependent control of both the count on the counter at the start of the countdown, as well as the count at the end of the countdown, the required ON/OFF ratio of the furnished signal may vary greatly. Further, a rapid matching to changes in speed is achieved, resulting in operating response.

An increased independence of the ON/OFF ratio of the input signal results from operation according to the principle of dwell angle decrease below a predetermined speed and according to the principle of dwell angle increase above this predetermined speed. The control circuit can then operate between ON/OFF ratios of about 40% to 90%. The speed at which the change is effected corresponds approximately to the speed at which the dwell angle has reached the level of the input signal. For lower speeds, a relatively low power dissipation is obtained by decrease of the dwell angle, and, after switching to dwell angle increase, good power efficiency is achieved at high speeds.

Since after switching from dwell angle increase to—decrease and vice versa, a certain amount of time is required until the correct dwell angle has again established itself it is particularly advantageous to provide a hysteresis for the speed-dependent switching operations, so that back-and-forth switching in the borderline region is avoided.

DRAWINGS

FIG. 1 shows a circuit diagram of the embodiment,

FIG. 2 a signal diagram for explaining the operation at bw speeds (closure angle decrease), and FIG. 3 a signal diagram for explaining the operation in the transition from closure angle decrease to closure angle increase.

DESCRIPTION OF THE EMBODIMENTS

Figure 1:
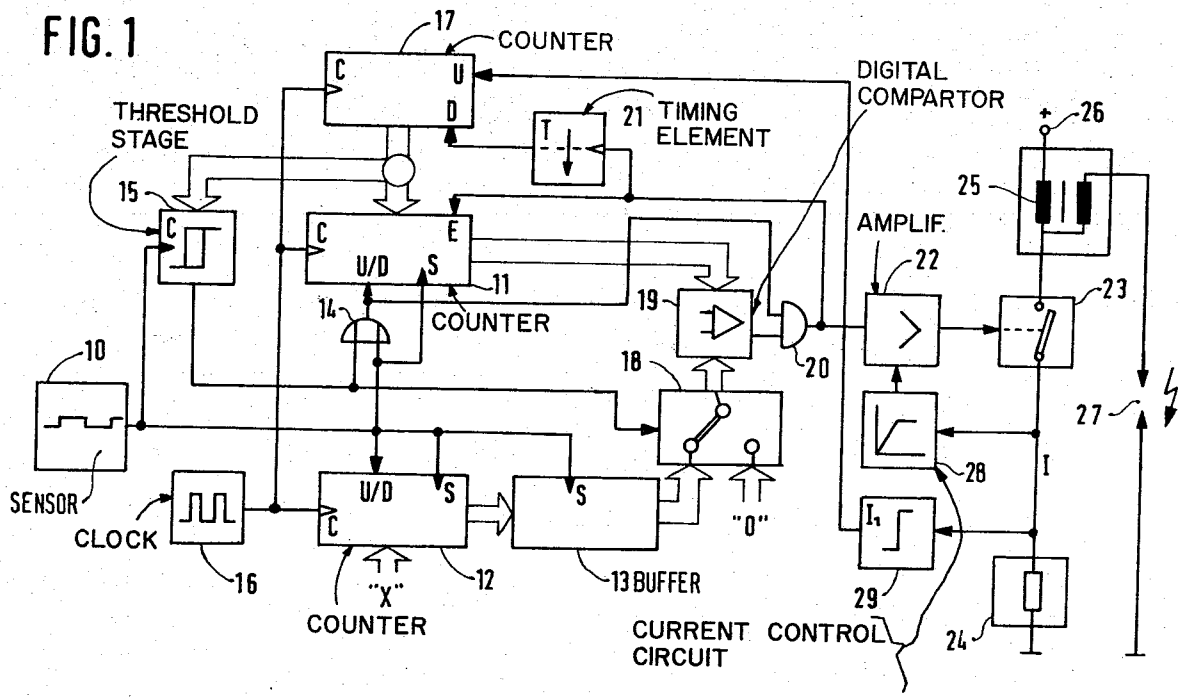

In the embodiment shown in FIG. 1, a sensor arrangement 10, which is preferably connected to the crankshaft of an internal combustion engine, is connected to the set input S of an open time counter 11, the input S of a triggering threshold counter 12, the set input S of a buffer storage 13; with the count direction input U/D of the counter 12; through an OR-gate 14 to the count direction input U/D of counter 11; and to the clock input C of a threshold value recognition stage 15. The sensor arrangement 10 can be associated with an ignition computer, which is not shown, to effect a change in the ignition timing in dependence on parameters of the internal combustion engine. Such an ignition computer can, for example, be constructed according to U.S. Pat. No. 4,063,539 or Ser. No. 06/221,788, now U.S. Pat. No. 4,337,744. It is important that the output signal of sensor arrangement 10 or of the ignition computer have an ON/OFF ratio which is approximately 40% to 90%. The counting inputs of counter 12 are preferably set to a counting value "X" by hard wiring, while the counting outputs are connected to buffer storage 13. A clock frequency generator 16 is connected to the clock inputs C of counters 11,12, as well as those of a control counter 17 whose counting outputs are connected to the counting inputs of counter 11, and to the threshold value recognition stage 15. The output of threshold value recognition stage 15 is connected to a further input of OR-gate 14, and to the control input of a switch 18 which is preferably constructed as a multiplexer. The outputs of switch 18 and those of counter 11 are applied to the comparator inputs of a digital comparator 19 whose output is connected through an AND-gate 20 to the blocking input E of counter 11 and is further connected through a timing element 21 to the countdown input D of counter 17. The output of OR-gate 14 is connected to a further input of AND-gate 20. The two inputs of switch 18 receive on the one hand the counting outputs of buffer storage 13 and, on the other hand, preferably by hard wiring, the number "0".

The output of AND-gate 20 is connected through an amplifier 22 to the control input of an electronic switch 23, whose switching circuit includes a current measuring resistor 24, as well as the primary winding of an ignition coil 25; together switch 23, resistor 24 and coil 25 constitute a series circuit connected between ground potential and a voltage supply 26. A spark gap 27 is connected into the secondary circuit of ignition coil 25. Spark gap 27 is generally a sprakplug in an internal combustion engine. A mechanical or electronic high voltage distributor can be provided in well-known fashion when a plurality of sparkplugs are present. A current control circuit 28 is connected to current measuring resistor 24 for the purpose of limiting the current on the primary side. Current control circuit 28 is known, for example, from U.S. Pat. No. 3,709,206, to which German Patent Disclosure Document No. DE-OS 2 232 220 corresponds. The output of the current control circuit is connected to amplifier 22. Furthermore, the voltage drop across current measuring resistor 24 is connected through a threshold stage 29 to the up-counting input (U) of counter 17.

Figure 2:
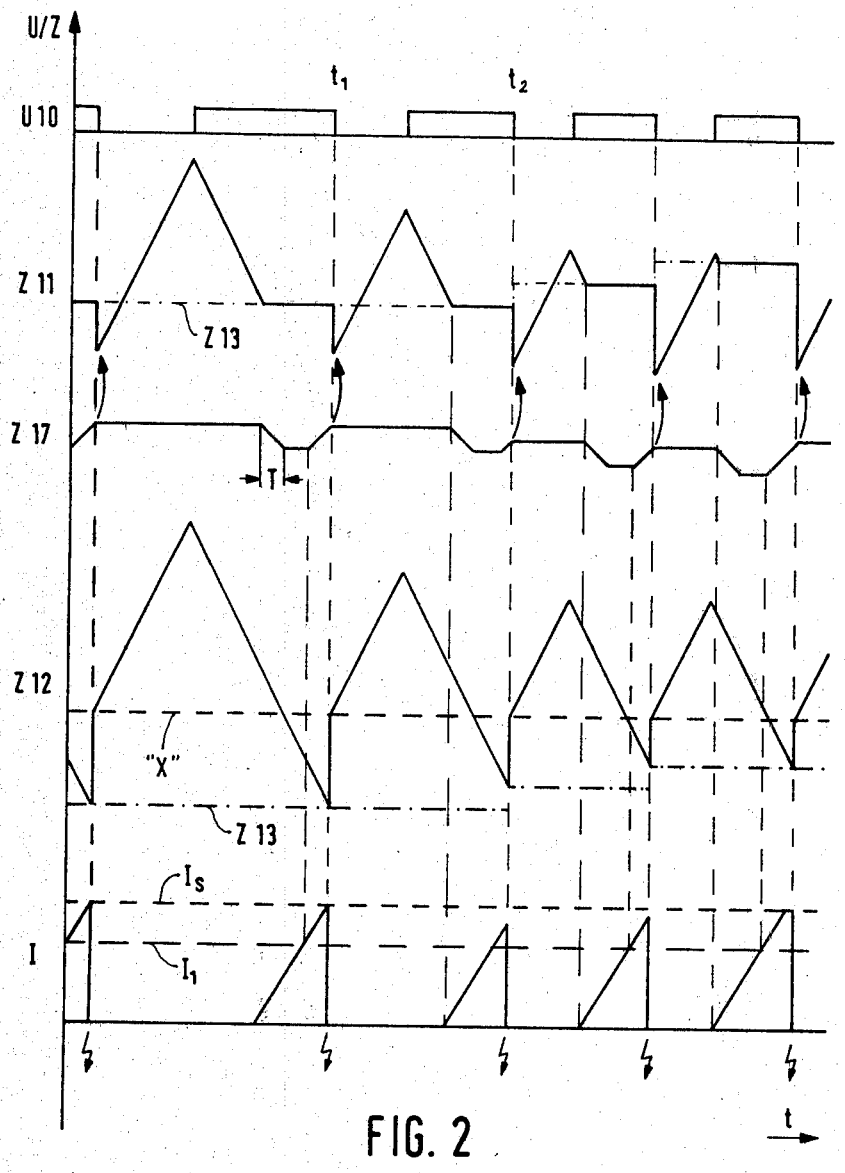

Operation, at low speeds, with reference to the signal diagram of FIG. 2. This low speed region extends approximately to that speed wherein a current flow on the primary side during the time of input signal U10 is no longer sufficient for the current to reach a desired current Is. Up to time t1, the operation is a steady state operation, during which, once the system has settled in, the primary current I always reaches its desired value Is. Each trailing edge of the input signal U10 causes counter 11 to be set to the count then present in counter 17. Counter 11 counts upwards during the OFF time in the input signal. Simultaneously, the count in counter 12 is taken over by buffer storage 13 and very shortly thereafter by delay in delay elements which may be required and are not illustrated in detail, the fixed counting value X is taken over by counter 12. Counter 12 also counts upwards during the OFF time in the input signal. At the start of the next subsequent input signal U10, the counting direction in both counters 11,12 is switched to the down counting mode via the counting direction inputs U/D of the two counters. If the value Z11 in counter 11 reaches the value Z13 applied to comparator 19 through switch 18, then the output of comparator 19 causes electronic switch 23 to be closed and a current I begins to flow on the primary side. In addition, the counter 11 is blocked for additional counting processes by blocking input E. Finally, the timing element 21 is triggered, so that a countdown takes place in counter 17 during the time determined by the timing element. If the current on the primary side reaches the value I1, then threshold stage 29 responds and effects an upward counting in counter 17 via the up-counting input U. Under steady state conditions, counter 17 again reaches its old count after the up and down counting processes. The following trailing edge of the input signal then again causes the two counters 11 and 12, as well as buffer storage 13, to be set. Since during steady state operation the final count in counter 12 at the time of the trailing edge of the input signal again has the same value as in the previous cycle, the count in buffer storage 13 is not changed. The change in signal at the output of OR-gate 14 causes electronic switch 23 to be opened via AND-gate 20, thereby triggering ignition. The primary current decreases to zero, so that the value is less than the threshold value of threshold stage 29. Counter 17 stops.

In the subsequent illustrated cycles, acceleration is illustrated, that is the input signals U10, which are constant with respect to angle, become shorter in time. Because of the shorter OFF periods in the input signal, a lower count is reached in counter 11, causing the closure time to start earlier. In spite of this, the desired value Is of the count is not reached at ignition time t2 since the speed information of course could not indicate any further acceleration. Because of the decreased time of current flow following the current value I1, the counting up in counter 17 takes place in a shorter time so that the value which is reached and taken over by counter 11 is less. This again decreases the value which can be reached in counter 11, so that an additional advance of the start of the closure time is effected in the next period. In addition, because of the shortened input signal, the count in counter 12 also does not reach the value of the previous period, but an increased value which increases the triggering threshold of comparator 19. This also causes a further advance of the closure time start. Together, these two measures cause a very rapid matching of the closure time to the changed speed conditions, even upon further acceleration. This even leads to the condition that in the last illustrated cycle, in which no further acceleration takes place, the duration of current flow is too long, so that the current regulator 28 becomes operative.

It must be emphasized that the control is effective not only for changes in speed, but of course also for changes of temperature and supply voltage, since these changes again influence the current on the primary side. However, the current on the primary side controls the value of counter 17.

For simplification of the presentation, a single clock frequency is applied to counters 11,12,17. The clock frequencies can of course be adjusted to achieve an optimum regulation. For example, in order to avoid control system oscillations, the counting frequency of counter 11 should be at least double that of counter 17. It has also proven advantageous to adjust the ratio of upward counting frequency and downward counting frequency in counter 11 in dependence on the ON/OFF ratios of the signal sequence U10. This is illustrated for example in U.S. Pat. No. 4,174,696.

Figure 3:
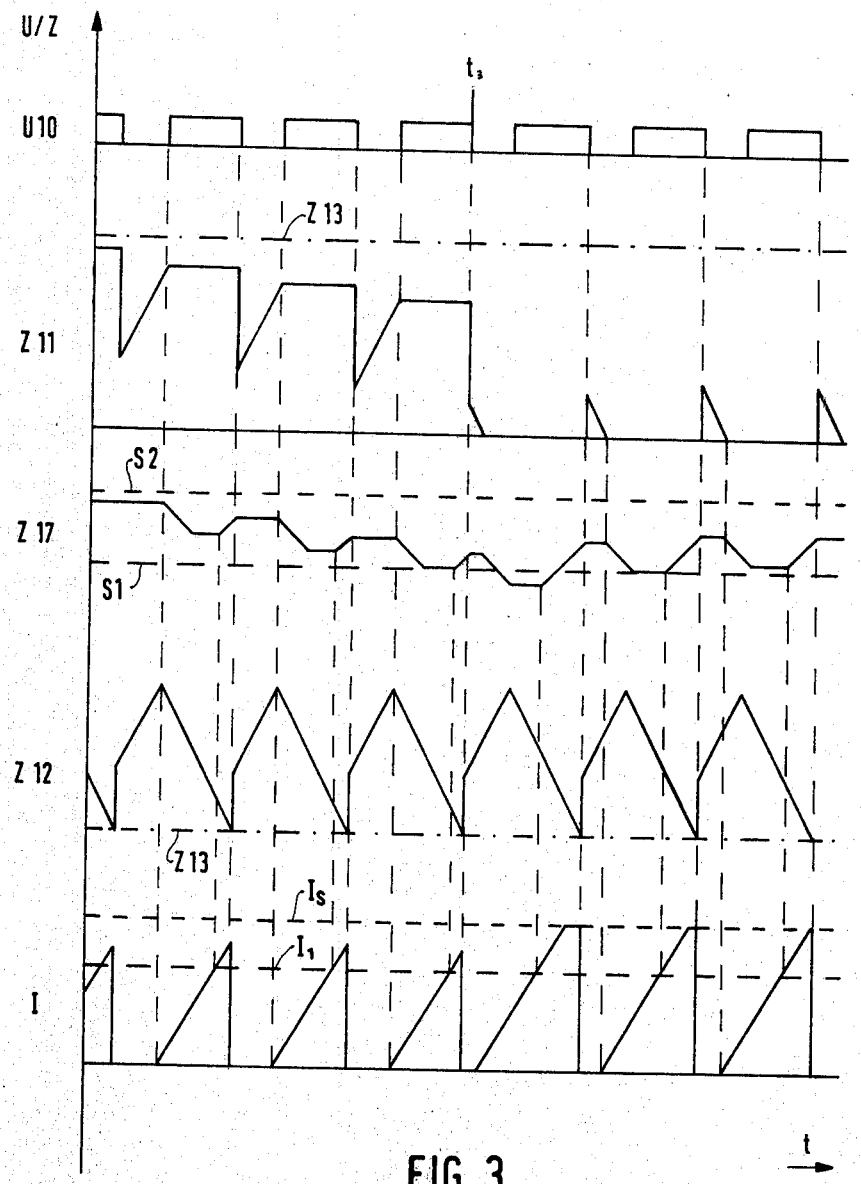

Operation at a constant high speed after a previous rapid acceleration with reference to FIG. 3: Because the speed is now constant, the value stored in buffer storage 13 remains constant. It is, however, higher than the value reached in counter 11, so that the output of comparator 13 steadily carries a 1 signal. This causes the start of the closure time to be triggered directly at the start of input signal U10 via OR-gate 14 and AND-gate 20. A countdown in counter 11 therefore no longer takes place. At this speed, the input signal U10 is already so short in time that the desired current value Is can no longer be reached, even if the closure time extends throughout the whole input signal. Thus, the count in counter 17 decreases continually by down-counting and lesser up-counting processes. After only a few periods during which a somewhat decreased current on the primary side was reached, the count in counter 17 again reaches the lower switching value S1 of the threshold value recognition stage 15. Because of the triggering of the threshold value recognition stage 15 by the trailing edges of the input signal, it takes to time t3 until this value is reached. Such triggering could, for example, also be achieved by a flipflop connected after the threshold stage. Because of the triggering of threshold stage 15, counter 11 is constantly switched to "down-counting" via OR-gate 14. At the same time, the counting value O is constantly applied to comparator 19 via switch 18 as a triggering threshold value. Immediately after counter 11 is set, this counter counts to the value zero and then initiates the closure time start. This at first results in an excessively long closure time, so that the current control stage 28 again responds. This excessively long current flow time starting with current value I1, however, immediately causes an increase in the value reached by counter 17, so that the correct current flow time will again be reestablished after very few periods. In the illustrated case, this is three periods. Counter 12 which continues to count, no longer affects the closure time.

Since the threshold value recognition stage 15 has hysteresis, switching back takes place only after the threshold value S2 has been passed. This is to prevent a constant switching between closure angle decrease and closure angle increase in the switching region because of the up/down counting processes of counter 17 and speed variations. The good dynamic behavior of the described dwell angle control system is the result of the fact that accelerations are sensed in each region: Acceleration during the OFF part of the input signal is detected by counter 11. Acceleration during an ON-part input signal is detected by counter 12. Finally, acceleration during the time that current flows is detected by counter 17.

In a simpler embodiment of the invention, the triggering threshold value counter 12 may be dispensed with and a fixed threshold value chosen. This of course must be bought at the price of a worse dynamic characteristic and a lesser allowable range of variation of the input signal ON/OFF ratios. Similarly, in a simplified embodiment of the invention wherein counter 12 is retained, it is possible to dispense with switching to the principle of dwell angle increase at high speeds. While allowing the saving of building blocks 15 and 18, this causes a limiting of the maximum primary current which can be reached at cut-off because of the limiting by the ON/OFF ratio. A transition to open time regulation by elements 15, 18 results in a substantial improvement of performance, in particular, for a high number of sparks e.g. for 8 cylinders.

We claim:

1. Ignition system for an internal combustion engine with an ignition coil, in whose primary circuit an electronic switch (23) and in whose secondary circuit at least one spark gap (27) is connected, with a dwell angle control device for controlling the electronic switch in dependence on the signals from a rotating sensor device (10) having a first UP/DOWN counter (17) in which the counting process in one direction is controlled by the interval of current flow in the primary circuit of the ignition coil starting with the passing of a current threshold value (I1) and in which the counting process in the other direction is constant with respect to time;

a second UP/DOWN counter (11) to which the counting values of the first counter (17) are transferred under control of the sensed signal, and whose counting direction is also determined by the sensed signals, the electronic switch (23) in the primary circuit of the ignition coil being closed upon reaching of an adjustable triggering threshold value by the count in the second counter (11), the switch being re-opened in response to an edge of the sensed signal, and comprising a third UP/DOWN counter (12), the adjustable trigger threshold value being determined by the final count of the UP/DOWN counter (12), the third UP/DOWN counter being set to a fixed value (X) by one edge of the sensed signals;

and wherein the counting direction of the third UP/-DOWN counter (12) is also determined by the sensed signals.

2. Ignition system according to claim 1, further comprising a buffer store (13) and a comparator (19);

wherein each final count of the third counter (12) is stored in the buffer store (13) after each UP/-DOWN count, the value stored in the buffer store, as well as the value of the second counter (11) are applied to the comparator (19), whose output controls the electronic switch (23).

3. Ignition system according to claim 1 or 2, characterized by means (15) responsive to a predetermined speed, connected to and controlling the triggering threshold of the second counter (11) and switching said threshold abruptly to another value, preferably the value zero;

and wherein the second counter (11) counts down the value taken over from the first counter (17) in one counting direction.

4. Ignition system according to claim 3, characterized in that the predetermined speed responsive means (15) for threshold value detection is connected to the first counter (17).

5. Ignition system according to claim 4, characterized in that the predetermined speed responsive means (15) control the triggering threshold with hysteresis.

6. Ignition system according to claim 3 including a multiplexer (18) connected to switch the speed dependent switching of the threshold value.

* * * * *